US006375760B2

(12) United States Patent
Maruta et al.

(10) Patent No.: US 6,375,760 B2
(45) Date of Patent: Apr. 23, 2002

(54) METHOD FOR CONTROLLING STRUCTURE OF TWO-PHASE STEEL

(75) Inventors: Kei-ichi Maruta; Michio Shimotomai; Yasunori Yonehana, all of Chiba; Yoshio Abe, Futtsu; Tomoyuki Yokota, Kawasaki; Yoshitaka Adachi, Osaka; Norikazu Matsukura, Kobe, all of (JP)

(73) Assignees: Kawasaki Steel Corporation, Kobe; Nippon Steel Corporation; NKK Corp., both of Tokyo, all of (JP)

( * ) Notice: Subject to any disclaimer, the term of this patent is extended or adjusted under 35 U.S.C. 154(b) by 0 days.

(21) Appl. No.: 09/731,532

(22) Filed: Dec. 8, 2000

(30) Foreign Application Priority Data

Dec. 17, 1999 (JP) ..... 11-358532
Nov. 2, 2000 (JP) ..... 2000-335431

(51) Int. Cl.[7] ..... C21D 1/04
(52) U.S. Cl. ..... 148/108; 148/685
(58) Field of Search ..... 148/108, 685

(56) References Cited

U.S. PATENT DOCUMENTS 5,885,370 A * 3/1999 Shimotomai et al. ..... 148/108

FOREIGN PATENT DOCUMENTS

JP A 11-315321 11/1999

OTHER PUBLICATIONS

P. Zoltan, "A magneses mezo hatasa az acel atalakulasi folyamataira", Gepgyartastechnologia, vol. 22 (1982) pp. 463–466, 1982.

Bulletin of the Japan Institute of Metals, vol. 38, No. 5(1999), pp. 380.

M. Shimotomai et al., "Aligned Two–Phase Structures in Fe–C Alloys", Scripta Materialia, vol. 32, (2000) pp. 499–503.

* cited by examiner

*Primary Examiner*—John Sheehan
(74) *Attorney, Agent, or Firm*—Oliff & Berridge, PLC

(57) ABSTRACT

A structure of a two-phase steel is controlled by subjecting a steel containing C: 0.05–0.80 mass % to a strain work in a true strain quantity of not less than 0.1 at a temperature zone of α-phase or γ-phase and then applying a magnetic field of 0.1–20 T thereto within a temperature range forming a two-phase zone of α-phase and γ-phase.

9 Claims, 7 Drawing Sheets

METHOD FOR CONTROLLING STRUCTURE OF TWO-PHASE STEEL

BACKGROUND OF THE INVENTION

1. Field of the Invention

This invention relates to a method for controlling a structure of a two-phase steel, and more particularly to a method for advantageously improving a steel structure in a good efficiency and a low cost by effectively utilizing a treatment through an application of a magnetic field in a production course of a two-phase steel.

2. Description of the Related Art

As a desirable property of a steel, it is required to have a high strength and a high toughness. In general, it is very difficult to simultaneously establish these two properties because the toughness of the steel lowers as the strength increases.

As means for establishing the two properties, there have hitherto been proposed a two-phase formation of the steel structure and a formation of fine crystal grains.

In the two-phase steel, the structure is very important for obtaining the desired properties, so that there are proposed various structure controlling methods.

In these conventional methods, however, satisfactory properties are not necessarily obtained, so that it is demanded to develop a new structure controlling method.

On the other hand, a method of conducting a high reduction rolling is used as means for forming fine grains, but there is already a limit in the improvement of the properties through a contrivance of the rolling method. Particularly, in case of the steel sheet, flat-shaped crystal grains increase in the rolling direction or a texture of aligning an orientation of the crystal grain in a certain direction develops, so that there are caused problems that an absorption ability of impact energy lowers, and the surface quality of the steel sheet is degraded, and the like.

For this end, it is desired to develop a new method for controlling the steel structure.

As one of such structure controlling methods, there is considered a method utilizing a magnetic field.

For example, Palmai Zoltan have reported (Gepgyartastechnologia. vol. 22(1982), page 463) that when a magnetic field of 0.57 T (T is a unit showing an intensity of a magnetic field: tesla) is applied during heat treatment for inversely transforming steel of Fe-0.60C-0.30Si-0.72Mn composition from martensite structure to austenite structure, ferrite phase is stabilized to increase residual ferrite amount as a study showing an effect of magnetic field to steel.

However, the above pioneering study is not industrially applied because the effect of the magnetic field is not clearly observed due to the weak magnetic field.

Moreover, there is not made a study or an invention on the structure control of steel utilizing the magnetic field up to the present time.

Since a superconducting magnet capable of applying a strong magnetic field has recently been developed, the inventors have made studies on the structure control of the steel utilizing the magnetic field.

As a result, the inventors have developed a method for controlling a structure of a two-phase steel wherein an inversely transformed austenite phase is aligned in a direction of an applied magnetic field by conducting an inverse transformation under heating in the magnetic field and disclosed in JP-A-11-315321, Bulletin of the Japan Institute of Metals, vol. 38, No. 5(1999), page 380 and Scripta materialia, vol. 32, (2000), page 499.

SUMMARY OF THE INVENTION

The invention lies in a further improvement of the above method and is to provide a method for controlling a structure of a two-phase steel wherein the control of two-phase structure can be made in a very short time by utilizing a treatment through application of a magnetic field during the structure control of the two-phase steel and the productivity can be increased by shortening the heating time and the cost can be reduced by decreasing the fuel cost for heating as compared with a case of controlling through usual heat treatment.

The inventors have made various studies in order to achieve the above object and discovered that when the steel is subjected to a work forming a true strain of not less than 0.1 prior to a heat treatment within a temperature range forming ($\alpha$–$\gamma$) two-phase zone or two-phase zone of $\alpha$-phase and $\gamma$-phase and then a magnetic field is applied in the heat treatment at such a two-phase zone, it is rendered into an aligned two-phase structure in the direction of the applied magnetic field in a very short time and such an alignment direction is determined only by the direction of applied magnetic field irrespectively of the previous forging direction, rolling direction or the like, and as a result, the invention has been accomplished.

That is, the invention lies in a method for controlling a structure of a two-phase steel, characterized in that a steel containing C: 0.05–0.80 mass % is subjected to a work forming a true strain of not less than 0.1 at a temperature zone of $\alpha$-phase or $\gamma$-phase and then a magnetic field of 0.1–20 T is applied thereto within a temperature range forming a two-phase zone of $\alpha$-phase and $\gamma$-phase.

BRIEF DESCRIPTION OF THE DRAWINGS

The invention will be described with reference to the accompanying drawings, wherein.

DETAILED DESCRIPTION OF THE INVENTION

The experimental results succeeding the invention will be described below.

A steel having a composition comprising C: 0.6 mass %, Si: 0.2 mass % and Mn: 0.4 mass % and the remainder being substantially Fe ($Ac_1$: 725° C., $Ac_3$: 785° C.) is hot rolled and then cold rolled to obtain a steel sheet having a thickness of 1.5 mm. Then, the steel sheet is heated to 870° C. and subjected to a rolling work corresponding to a true strain of 0.2 at this temperature and thereafter subjected to a heat treatment at 745° C. being a temperature of ($\alpha+\gamma$) two-phase zone for 1 minute while applying a magnetic field of 8 T in parallel to the rolling direction and then quenched and cooled to room temperature. On the other hand, a part of the steel sheet is subjected to the same heat treatment as mentioned above while applying the magnetic field in a direction perpendicular to the surface of the sheet.

After the thus obtained steel sheet is cut in a thickness direction, the cut surface is polished and corroded with an alcohol solution of 3 vol % nitric acid and then observed by means of a microscope.

As a result of observing the section in parallel to the direction of the applied magnetic field, it has been confirmed that the residual austenite phase (observed as martensite phase after the quenching) and ferrite phase formed through transformation are aligned in the direction of the applied magnetic field irrespectively of the hot rolling direction. And also, it has been confirmed that cell-shaped structure is formed in the section perpendicular to the direction of the applied magnetic field.

From the above result, it has been found that it is possible to control the structure through the transformation in a very short time by conducting the heat treatment in the magnetic field after strain is applied to the steel irrespectively of the history such as rolling and the like.

A mechanism of a phenomenon that when the steel is applied with strain at an $\alpha$-phase (ferrite phase) temperature zone or a $\gamma$-phase (austenite phase) temperature zone and then subjected to an application of a magnetic field within a temperature range of a two-phase zone of $\alpha$-phase and $\gamma$-phase according to the invention, the structure of the steel is rendered into a form aligned in the direction of the applied magnetic field is considered as follows.

Figure 1:
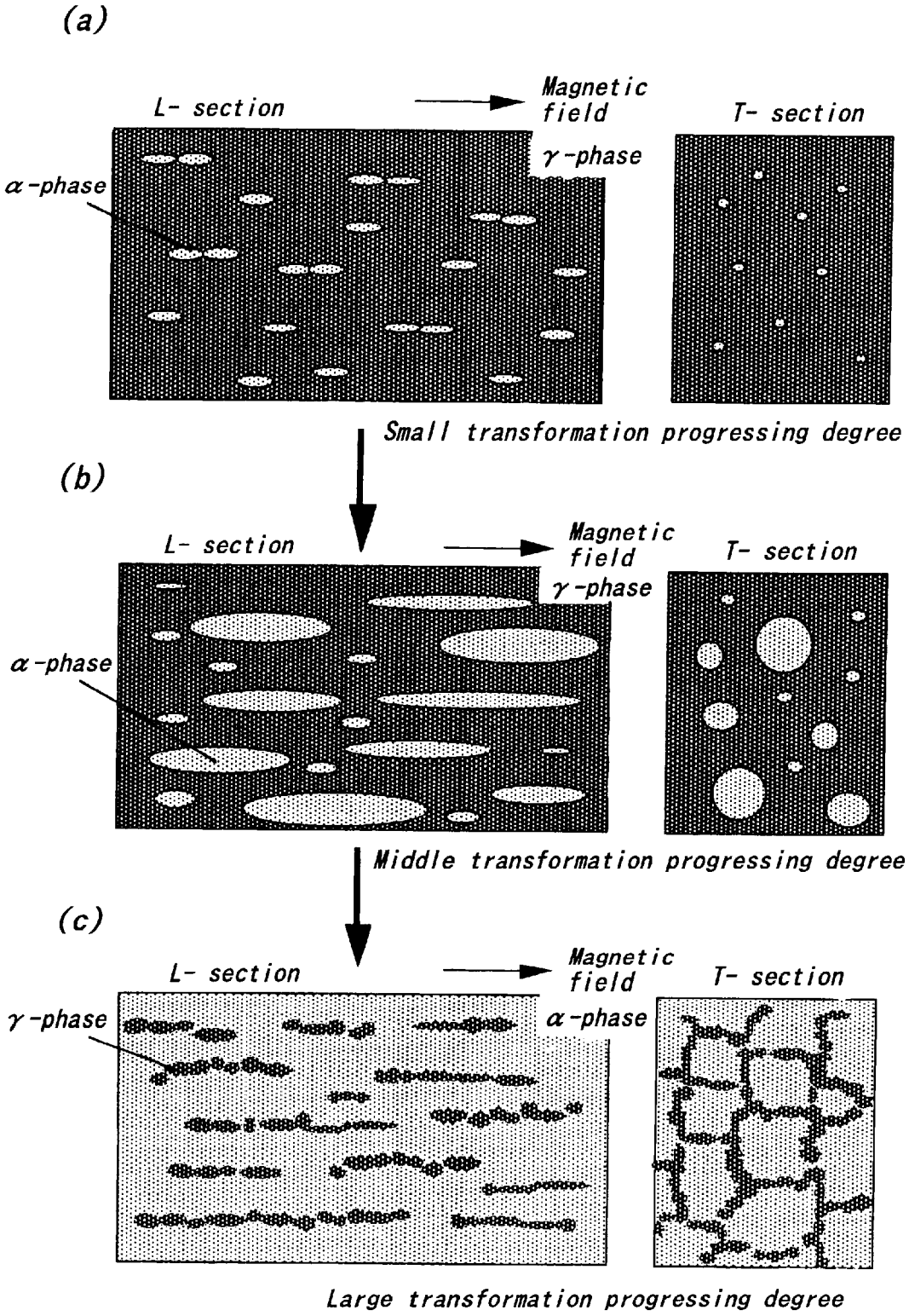
FIG. 1 is a diagram showing a model of an aligned structure in a magnetic field with a lapse of time in case of normal transformation, wherein (a) is a case that a transformation progressing degree is small, and (b) is a case that a transformation progressing degree is middle, and (c) is a case that a transformation progressing degree is large.

In FIGS. 1(*a*), (*b*) and (*c*) are shown models of the structure in the magnetic field with the lapse of time in normal transformation in accordance with a progressing degree of the transformation, respectively. Each of these figures shows L-section (longitudinal section) parallel to the direction of the applied magnetic field and T-section (transverse section) perpendicular to the direction of the applied magnetic field.

When the transformation is carried out in the magnetic field, nuclei of ferromagnetic ferrite phase are generated in an inside of a paramagnetic austenite phase. In this case, they take a shape of minimizing an increase of whole magnetostatic energy.

Such a shape is considered to be a rotary aligned in the direction of the magnetic field. Such a state is shown in FIG. 1(*a*) corresponding to a small transformation progressing degree.

As the transformation progressing degree becomes middle, the nuclei of ferrite phase are grown and united to form a chain-shaped structure (see FIG. 1(*b*)).

When the transformation progressing degree becomes finally large, an elongated two-phase structure indicating a structure aligned in the direction of the applied magnetic field at L-section and a cell-shaped form, hereinafter called as a honeycomb-shaped structure, at T-section is formed (see FIG. 1(*c*)).

In case of the above normal transformation, when the steel is subjected to strain work at a $\gamma$-phase temperature zone, strain energy is stored in an inside of the steel by such a work to increase point of generating transformation nucleus. And also, many dislocations and vacancies are formed to considerably enhance atom moving degree. As a result, the transformation progresses very rapidly.

Figure 2:
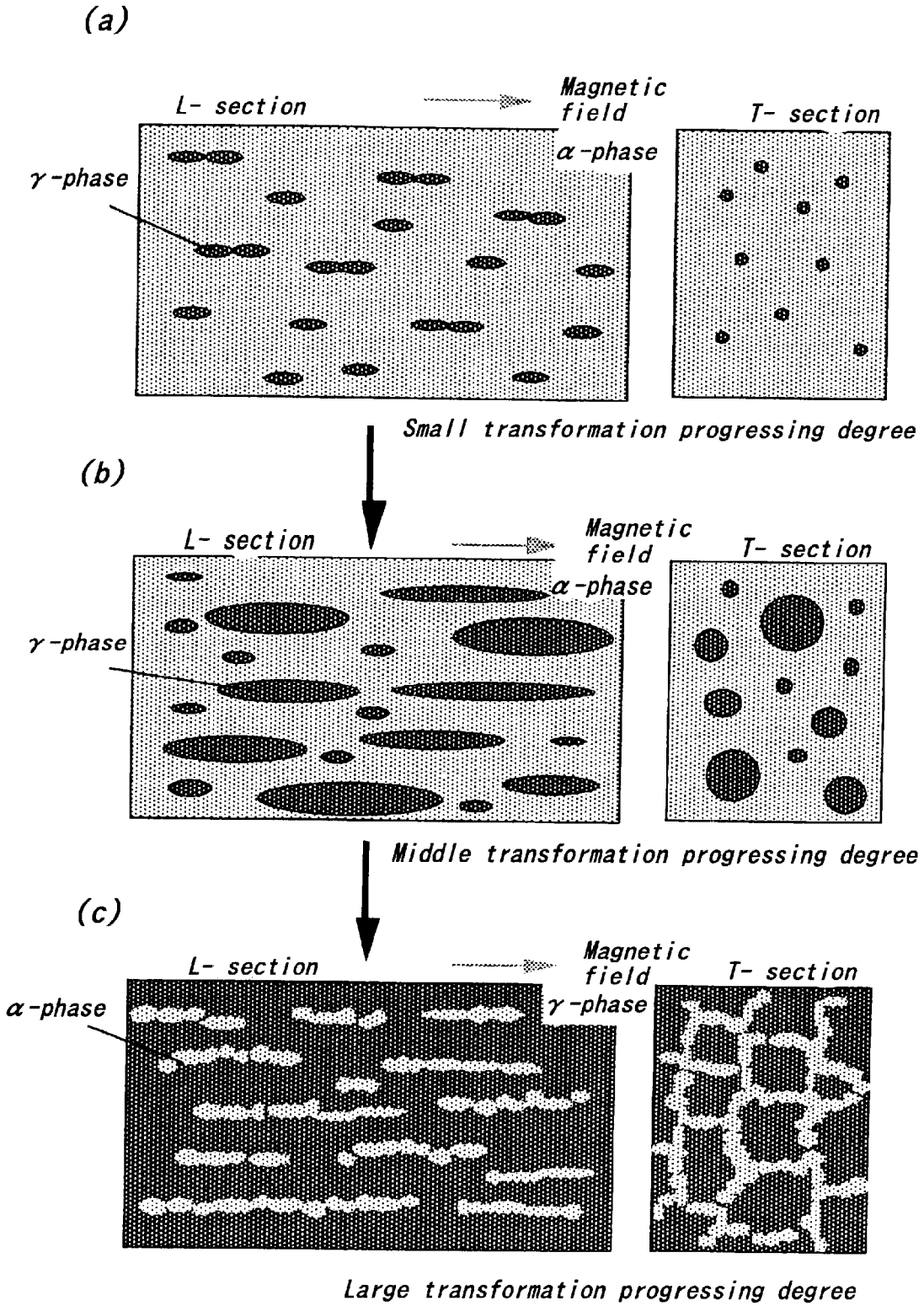
FIG. 2 is a diagram showing a model of an aligned structure in a magnetic field with a lapse of time in case of inverse transformation, wherein (a) is a case that a transformation progressing degree is small, and (b) is a case that a transformation progressing degree is middle, and (c) is a case that a transformation progressing degree is large.

In FIGS. 2(*a*), (*b*) and (*c*) are shown models of the structure in the magnetic field with the lapse of time in inverse transformation in accordance with a progressing degree of the transformation, respectively.

In this case, nuclei of paramagnetic austenite phase are generated in an inside of ferromagnetic ferrite phase so as to minimize whole magneto-static energy likewise the case of normal transformation (see FIG. 2(*a*)).

Thereafter, as the transformation progressing degree becomes middle, the growth and uniting of austenite phase are promoted to form a chain-shaped structure (see FIG. 2(*b*)). Finally, a honeycomb-shaped structure is formed at a stage of a large transformation progressing degree (see FIG. 2(*c*)).

Even in case of the above inverse transformation, when the steel is subjected to strain work at room temperature or a warm temperature, strain energy is stored in an inside of the steel by such a work to increase sites for generating transformation nucleus. And also, many dislocations and vacancies are formed to considerably enhance atom moving degree. As a result, the transformation progresses very rapidly.

In brief, the invention is adaptable for all practical steels as long as the two-phase steel consists of paramagnetic phase and ferromagnetic phase, and also the method according to the invention is applicable regardless of normal transformation and inverse transformation.

Figure 3:
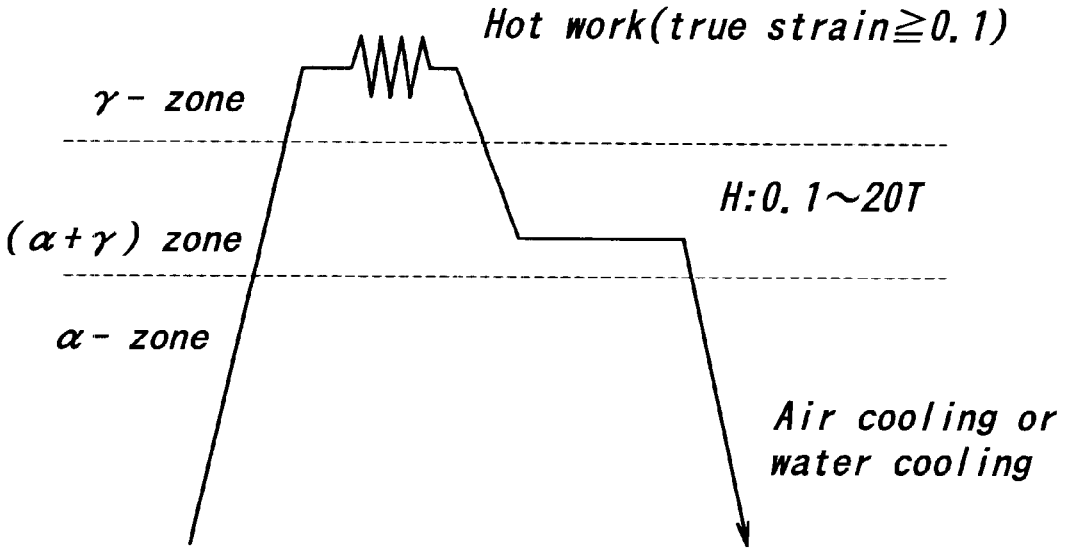
FIG. 3 is a diagram showing a pattern of a heat treatment when normal transformation is carried out at a two-phase zone after the work at a high temperature zone.
Figure 4:
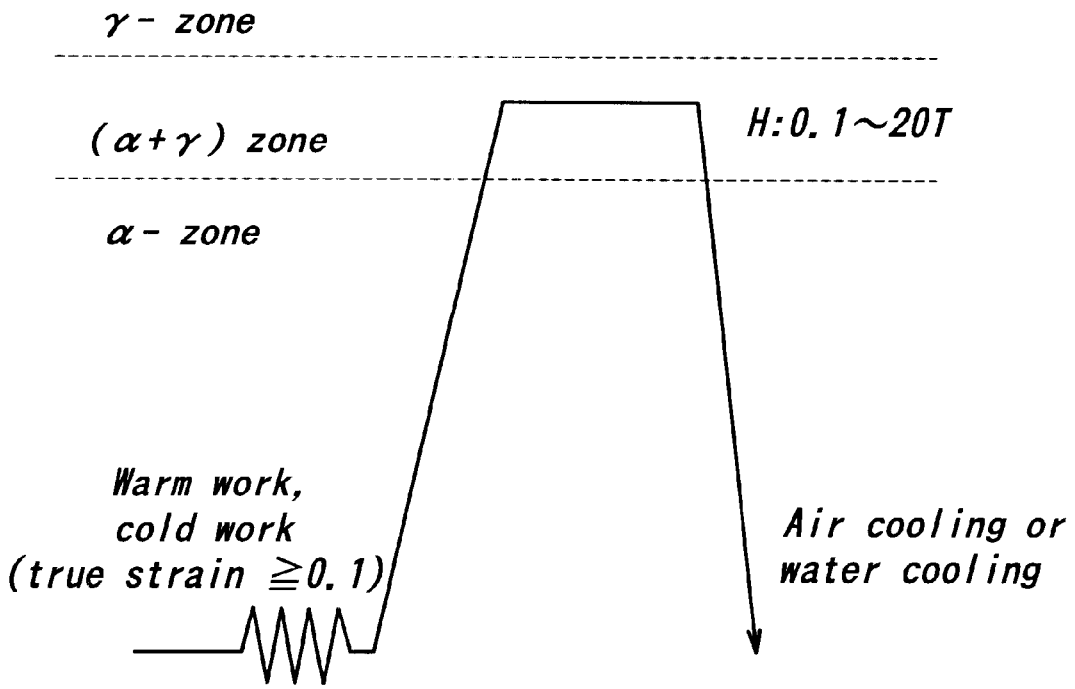
FIG. 4 is a diagram showing a pattern of a heat treatment when inverse transformation is carried out by heating at a two-phase zone after a warm or cold work.

An example of the above method is shown in FIGS. 3 and 4, respectively.

FIG. 3 is a case that normal transformation is carried out at a two-phase zone after the steel is subjected to strain work at a high temperature zone corresponding to $\gamma$-phase temperature zone, while FIG. 4 is a case that inverse transformation is carried out by heating to a two-phase zone after the steel is subjected to strain work at a warm or cold temperature corresponding to $\alpha$-phase temperature zone.

Even in both cases, the heat treatment is ended in a very short time, so that it is very easy to apply the method to an industrial production line.

The reason why the steel composition and the heat treating conditions in the invention are restricted to the aforementioned ranges will be described below.

The invention is adaptable for all steels having any composition as long as they have a state of coexisting paramagnetic phase and ferromagnetic phase. In this case, C is sufficient to be included in the following range as a basic condition.

C: 0.05–0.8 mass %

The reason why the lower limit of C is 0.05 mass % is due to the fact that when the C amount is less than 0.05 mass %, the temperature in the two-phase zone becomes too high and strain energy is not effectively stored, while the reason why the upper limit is 0.8 mass % is due to the fact that when the C amount exceeds eutectoid composition, the transformation at ($\alpha+\gamma$) two-phase zone does not occur.

Then, the reason why the steel is subjected to a work at a true strain of not less than 0.1 prior to the heat treatment in the magnetic field is based on the fact that strain energy is stored in the inside of the steel by such a work and dislocations or the like resulting in a nucleus generating point for transformation are formed to promote the transformation under heating in a short time. When the strain quantity is less than 0.1, the nucleus generating site is not sufficiently formed in the inside of the steel and hence the transformation can not be promoted in the short time.

Moreover, the form of the work may take any one of rolling, drawing and the like. In this case, however, it is required to store strain energy corresponding to true strain of 0.1 or more in the steel, so that it is important that such a strain energy is not lost by subsequent recovery recrystallization or the like.

And also, the reason why the temperature zone conducting the above work treatment is limited to $\alpha$-phase temperature zone or $\gamma$-phase temperature zone is due to the fact that the transformation is caused after strain is sufficiently stored in the single phase zone.

Further, the reason why the intensity of the magnetic field applied in the heat treatment is limited to 0.1–20 T is due to the fact that when it is less than 0.1 T, the magnetic effect is small and the above chain-shaped structure or honeycomb structure is not effectively obtained, while the upper limit of 20 T is determined by an intensity of the magnetic field able to industrially generate in a big space. The intensity of the magnetic field is preferably 1–20 T, more particularly 4–20 T.

Moreover, the kind of the magnetic field may be either of static magnetic field and low frequency varying magnetic field, but direct current static magnetic filed is usually favorable.

As to the temperature in the application of the magnetic field, it is essential to keep the steel at a temperature of two-phase zone for forming aligned two-phase structure through the transformation.

In the invention, therefore, the heat treating temperature to be conducted in the application of the magnetic field after the work at $\alpha$-phase temperature zone or $\gamma$-phase temperature zone is restricted to a temperature range corresponding to ($\alpha+\gamma$) two-phase temperature zone, i.e. a two-phase zone of $\alpha$-phase and $\gamma$-phase.

According to the invention, the transformation is completed in a very short time, so that the heating time is not particularly restricted, but is preferably not less than 10 seconds.

Moreover, the invention is applicable for all of usual steel materials such as steel sheet, steel wire, rod steel, shape steel and the like.

The following examples are given in illustration of the invention and are not intended as limitations thereof;

EXAMPLE 1

A steel comprising C: 0.61 mass %, Si: 0.45 mass % and Mn: 0.60 mass % ($Ac_1$: 730° C., $Ac_3$: 788° C.) is provided by melting under vacuum. A specimen having a length of 150 mm, a width of 25 mm and a thickness of 2 mm is cut out from the steel and sufficiently rendered into $\gamma$-phase by heating to 870° C. and then hot rolled under a condition that true strain quantity is varied within a range of 0.05–1.0 at a state of keeping this temperature. Immediately thereafter, the specimen is placed in a furnace at a position that a magnetic field of a superconducting magnet is maximum (magnetic field: 10 T), at where it is kept at 745° C. for 1 minute while applying the magnetic field in a thickness direction to conduct normal transformation. Then, the specimen is water-quenched.

The rolled face of the thus obtained steel sheet is polished, corroded with an alcohol solution of 3% nitric acid and observed by means of an optical microscope. As a result, it is confirmed that the steel sheet has a two-phase structure of ferrite phase and austenite phase (observed as martensite phase after the quenching) formed through the transformation.

Then, an alignment degree of martensite phase in the direction of the applied magnetic field observed in the structure is determined by the following method.

When the direction of the applied magnetic field is called as z-axis, the structure observation is carried out at a face parallel to the z-axis, during which a length of martensite phase in the z-direction is measured by an image processing of the micrograph. Then, the structure observation is carried out at a face perpendicular to the z-axis, during which an extending size of martensite phase observed in such a face is determined by an image processing. In the case, when the structure in such a face is cell-shaped, the cell is measured.

Next, a ratio of the two sizes (length in the z-axis direction/extending size in a face perpendicular to the z-axis) is determined. Such a ratio is measured over the whole of the structure photograph and an average of the measured values is calculated as an alignment degree.

According to this method, as the alignment degree becomes large, the alignment of the structure through the magnetic field promotes. In the invention, it is defined that the effect of controlling the structure through the magnetic field is caused at the alignment degree of not less than 1.5.

The measured results are shown in Table 1.

TABLE 1

| No. | True strain quantity | Heating time (min) | Alignment degree | Observation result of structure | Remarks |
|---|---|---|---|---|---|
| 1 | 0.05 | 1.0 | 0.9 | Mixed grain structure of martensite phase and ferrite phase | Comparative Example 1 |
| 2 | 0.1 | 1.0 | 1.6 | Honeycomb-shaped structure of martensite phase and ferrite phase | Acceptable Example 1 |
| 3 | 0.4 | 1.0 | 2.5 | Honeycomb-shaped structure of martensite phase and ferrite phase | Acceptable Example 2 |
| 4 | 0.8 | 1.0 | 3.0 | Honeycomb-shaped structure of martensite phase and ferrite phase | Acceptable Example 3 |
| 5 | 1.0 | 1.0 | 3.2 | Honeycomb-shaped structure of martensite phase and ferrite phase | Acceptable Example 4 |
| 6 | 0.05 | 45.0 | 1.6 | Chain-shaped structure of martensite phase and ferrite phase | Comparative Example 2 |

As seen from Table 1, in all of Examples 1–4, the alignment degree is sufficiently improved by keeping under heating for 1 minute to obtain a two-phase honeycomb-shaped structure, which corresponds to a model shown in FIG. 1(*c*) having a large transformation progressing degree.

On the contrary, Comparative Example 1 is small in the true strain quantity, so that the alignment degree is low and the sufficient control of two-phase structure is not conducted and hence the transformation progressing degree is small and the structure is a mixed grain structure. On the other hand, in Comparative Example 2 that the true strain quantity is the same in Comparative Example 1, the alignment degree of 1.6 is finally obtained, but the steel structure is a chain-shaped structure along the z-axis and very immature honeycomb-shaped structure perpendicular to the z-axis.

EXAMPLE 2

A steel comprising C: 0.2 mass %, Si: 0.2 mass %, Mn: 1.3 mass % and Ti; 0.1 mass % ($Ac_1$: 715° C., $Ac_3$: 875° C.) is provided by melting under vacuum. A specimen having a length of 150 mm, a width of 25 mm and a thickness of 2 mm is cut out from the steel and rendered into γ-phase by induction heating at 1000° C. and then hot rolled under a condition that true strain quantity is varied within a range of 0.05–1.0 and subsequently placed in a furnace at a position that a magnetic field of a superconducting magnet is maximum (magnetic field: 10 T), at where it is kept at 800° C. corresponding to (α+γ) two-phase zone for 0.5 minute while applying the magnetic field of 10 T in a thickness direction to conduct normal transformation. Then, the specimen is quenched.

The rolled face of the thus obtained steel sheet is polished, corroded with an alcohol solution of 3% nitric acid and observed by means of an optical microscope. As a result, it is confirmed that the steel sheet has a two-phase structure of cc-phase and y-phase (observed as martensite phase after the quenching) formed through the transformation.

Then, the alignment degree of martensite phase in the direction of the applied magnetic field observed in the structure is determined by die aforementioned method.

And also, a tension test piece having a length of parallel portion of 40 mm, a width of 5 mm and a whole length of 70 mm is cut out from the steel sheet so as to coincide the rolling direction with a length direction to measure a tensile strength (tension speed: 10 mm/s) and a total elongation. Further, a plate-shaped piece having a length of 50 mm, a width of 10 mm and a thickness of 2 mm is cut out and a U-notch is formed thereon, which is subjected to an impact test at room temperature to measure an absorption energy for evaluating toughness.

The measured results are shown in Table 2.

TABLE 2

| No. | True strain quantity | Heating time (min) | Alignment degree | Observation result of structure | Tensile strength (MPa) | Total elongation (%) | Absorption energy (J) | Remarks |
|---|---|---|---|---|---|---|---|---|
| 7 | 0.05 | 0.5 | 0.9 | Mixed grain structure of martensite phase and ferrite phase | 300 | 12 | 50 | Comparative Example 3 |
| 8 | 0.1 | 0.5 | 1.8 | Honeycomb-shaped structure of martensite phase and ferrite phase | 580 | 30 | 100 | Acceptable Example 5 |
| 9 | 0.4 | 0.5 | 2.5 | Honeycomb-shaped structure of martensite phase and ferrite phase | 620 | 32 | 115 | Acceptable Example 6 |
| 10 | 0.8 | 0.5 | 4.0 | Honeycomb-shaped structure of martensite phase and ferrite phase | 650 | 33 | 120 | Acceptable Example 7 |
| 11 | 1.0 | 0.5 | 4.9 | Honeycomb-shaped structure of martensite phase and ferrite phase | 700 | 34 | 125 | Acceptable Example 8 |
| 12 | 0.05 | 45.0 | 1.6 | Chain-shaped structure of martensite phase and ferrite phase | 390 | 17 | 60 | Comparative Example 4 |

As seen from Table 2, in all of Examples 5–8, the alignment degree is sufficiently improved by keeping under heating for 0.5 minute and the honeycomb-shaped two-phase structure is obtained.

Figure 5:
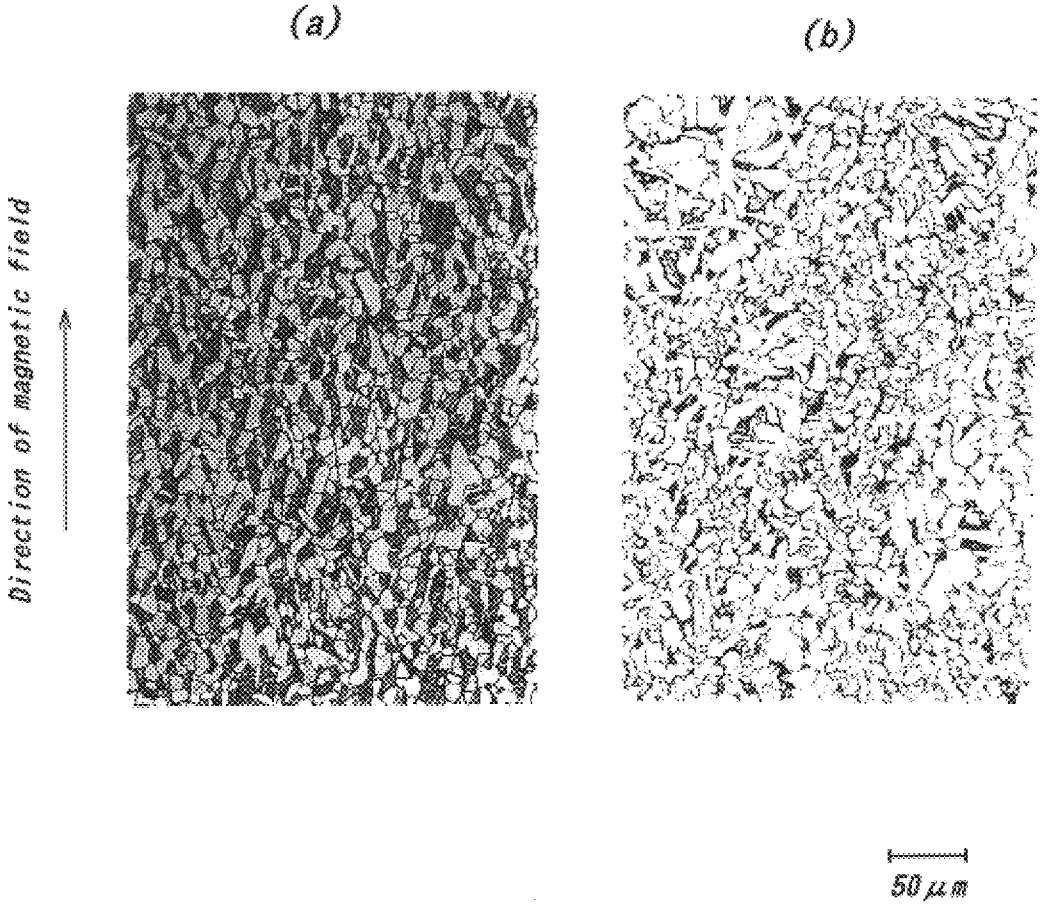
FIG. 5 is a microphotograph of a steel structure normally transformed in a magnetic field, wherein (a) is a case of Example 5 and (b) is a case of Comparative Example 3.

In FIG. 5(*a*) is shown a photograph of the structure in a face parallel to the direction of the applied magnetic field in the steel of Example 5, which corresponds to a model shown in FIG. 1(*c*) having a large transformation progressing degree.

On the contrary, Comparative Example 3 is small in the true strain quantity, so that the alignment degree is low and the sufficient control of two-phase structure is not conducted and hence the transformation progressing degree is small and the structure is a mixed grain structure. A photograph of such a structure is shown in FIG. 5(*b*). On the other hand, in Comparative Example 4 that the heating is kept for 45 minutes at the same true strain quantity as in Comparative Example 3, the alignment degree of 1.6 is finally obtained, but the steel structure is a chain-shaped structure along the z-axis and very immature honeycomb-shaped structure perpendicular to the z-axis.

Moreover, the invention examples having a high alignment degree and a honeycomb-shaped two-phase structure are excellent in the mechanical properties and show good properties such as strength, elongation and toughness as compared with the comparative examples.

EXAMPLE 3

This example is an experiment for inverse transformation.

A steel comprising C: 0.61 mass %, Si: 0.20 mass % and Mn: 0.45 mass % ($Ac_1$: 724° C., $Ac_3$: 782° C.) is provided by melting under vacuum. The steel is hot rolled, pickled and cold rolled. In this case, a true strain quantity applied to the steel is varied within a range of 0.04–1.1.

Then, the steel is placed in a furnace at a position that a magnetic field of a superconducting magnet is maximum (magnetic field: 10 T), at where it is kept at 745° C. for 1 minute while applying the magnetic field in a thickness direction to conduct inverse transformation. Then, the steel is water quenched.

With respect to the thus obtained steels, the structure is evaluated in the same manner as in Example 1. Moreover, a ratio (length in the z-axis direction/extending size in a face perpendicular to the z-axis) of α-phase is determined. Such a ratio is measured over the whole of the structure photograph and an average of the measured values is calculated as an alignment degree.

The measured results are shown in Table 3.

TABLE 3

| No. | True strain quantity | Heating time (min) | Alignment degree | Observation result of structure | Remarks |
|---|---|---|---|---|---|
| 13 | 0.04 | 1.0 | 0.8 | Mixed grain structure of martensite phase and ferrite phase | Comparative Example 5 |
| 14 | 0.1 | 1.0 | 1.6 | Honeycomb-shaped structure of martensite phase and ferrite phase | Acceptable Example 9 |
| 15 | 0.5 | 1.0 | 2.4 | Honeycomb-shaped structure of martensite phase and ferrite phase | Acceptable Example 10 |
| 16 | 0.8 | 1.0 | 2.9 | Honeycomb-shaped structure of martensite phase and ferrite phase | Acceptable Example 11 |
| 17 | 1.1 | 1.0 | 3.2 | Honeycomb-shaped structure of martensite phase and ferrite phase | Acceptable Example 12 |
| 18 | 0.05 | 45.0 | 1.6 | Chain-shaped structure of martensite phase and ferrite phase | Comparative Example 6 |

As seen from Table 3, in all of Examples 9–12, the alignment degree is sufficiently improved by keeping under heating for 1 minute to obtain a two-phase honeycomb-shaped structure, which corresponds to a model shown in FIG. 2(*c*) having a large transformation progressing degree.

On the contrary, in Comparative Example 5 that the true strain quantity is as low as 0.04, the alignment degree is low in the keeping for about 1 minute and the control of two-phase structure is insufficient and hence the transformation progressing degree is small and the structure is a mixed grain structure. On the other hand, in Comparative Example 6 that the heating is kept for 45 minutes at the same true strain quantity as in Comparative Example 5, the alignment degree of 1.6 is finally obtained, but the steel structure is a chain-shaped structure along the z-axis and very immature honeycomb-shaped structure perpendicular to the z-axis

EXAMPLE 4

In this example is examined an influence of steel composition upon the steel structure.

Various steels having C amounts varied as shown in Table 4 and structural steels having a usual composition are provided by melting under vacuum. Then, specimens having a length of 150 mm, a width of 25 mm and a thickness of 2 mm are cut out from these steels. Thereafter, they are rendered into γ-phase by induction heating at 1000° C. and hot rolled under a condition corresponding to a true strain quantity of 0.3 and subsequently placed in a furnace at a position that a magnetic field of a superconducting magnet is maximum, at where they are kept at a (α+γ) two-phase zone temperature shown in Table 4 for 0.5 minute while applying the magnetic field of 10 T in a thickness direction to conduct normal transformation. Then, they are quenched.

With respect to the thus obtained steels, the evaluation of the structure is carried out in the same manner as in Example 1.

The results are also shown in Table 4.

TABLE 4

| | Composition (mass %) | | | | | Heat treating temperature | Alignment | Observation result | |
|---|---|---|---|---|---|---|---|---|---|
| No. | C | Si | Mn | Ti | Nb | (° C.) | degree | of structure | Remarks |
| 19 | 0.03 | 0.20 | 0.45 | — | — | 770 | 1.3 | Mixed grain structure of martensite phase and ferrite phase | Comparative Example 7 |
| 20 | 0.10 | 0.20 | 0.45 | — | — | 770 | 3.3 | Honeycomb-shaped structure of martensite phase and ferrite phase | Acceptable Example 13 |
| 21 | 0.39 | 0.20 | 0.45 | — | — | 770 | 3.5 | Honeycomb-shaped structure of martensite phase and ferrite phase | Acceptable Example 14 |
| 22 | 0.61 | 0.20 | 0.45 | — | — | 750 | 3.2 | Honeycomb-shaped structure of martensite phase and ferrite phase | Acceptable Example 15 |
| 23 | 0.75 | 0.20 | 0.45 | — | — | 750 | 3.5 | Honeycomb-shaped structure of martensite phase and ferrite phase | Acceptable Example 16 |
| 24 | 0.85 | 0.20 | 0.40 | — | — | 750 | 1.1 | Mixed grain structure of martensite phase and cementite phase | Comparative Example 8 |
| 25 | 0.11 | 0.22 | 1.31 | — | 0.05 | 800 | 3.5 | Honeycomb-shaped structure of martensite phase and ferrite phase | Acceptable Example 17 |

TABLE 4-continued

| No. | Composition (mass %) C | Si | Mn | Ti | Nb | Heat treating temperature (° C.) | Alignment degree | Observation result of structure | Remarks |
|---|---|---|---|---|---|---|---|---|---|
| 26 | 0.30 | 1.50 | 0.60 | 0.05 | — | 800 | 4.0 | Honeycomb-shaped structure of martensite phase and ferrite phase | Acceptable Example 18 |
| 27 | 0.06 | 1.40 | 2.01 | — | — | 800 | 4.3 | Honeycomb-shaped structure of martensite phase and ferrite phase | Acceptable Example 19 |

As seen from Table 4, all of Examples 13–16 satisfying an adequate range of C amount conduct proper control of two-phase structure.

On the contrary, the proper control of two-phase structure is not conducted in Comparative Examples 7 and 8 that the C amount is outside the range defined in the invention.

As shown in Examples 17–19, the control of sufficiently aligned two-phase structure is attained even in the structural steels having the usual composition.

EXAMPLE 5

In this example is examined an influence of C amount in inverse transformation.

Various steels having C amounts varied as shown in Table 5 (the other components are Si: 0.20 mass % and Mn: 0.45 mass %) are provided by melting under vacuum. They are hot rolled and cold rolled (corresponding to true strain of 0.2) to a thickness of 1.5 mm and pickled. They are placed in a furnace at a position that a magnetic field of a superconducting magnet is maximum, at where they are subjected to a heat treatment in the magnetic field. That is, they are subjected to a heat treatment at 750° C. for 1 minute while applying the magnetic field of 10 T in a thickness direction to conduct inverse transformation.

With respect to the thus obtained steel sheets, the evaluation of the structure is conducted in the same manner as in Example 3.

The results are also shown in Table 5.

TABLE 5

| No. | C amount (mass %) | Alignment degree | Observation result of structure | Remarks |
|---|---|---|---|---|
| 28 | 0.03 | 1.3 | Mixed grain structure of martensite phase and ferrite phase | Comparative Example 9 |
| 29 | 0.10 | 2.2 | Honeycomb-shaped structure of martensite phase and ferrite phase | Acceptable Example 20 |
| 30 | 0.39 | 2.3 | Honeycomb-shaped structure of martensite phase and ferrite phase | Acceptable Example 21 |
| 31 | 0.61 | 2.2 | Honeycomb-shaped structure of martensite phase and ferrite phase | Acceptable Example 22 |
| 32 | 0.75 | 2.3 | Honeycomb-shaped structure of martensite phase and ferrite phase | Acceptable Example 23 |
| 33 | 0.85 | 1.1 | Mixed grain structure of martensite phase and cementite phase | Comparative Example 10 |

As seen from Table 5, all of Examples 20–23 satisfying an adequate range of C amount conduct proper control of two-phase structure.

On the contrary, the proper control of two-phase structure is not conducted in Comparative Examples 9 and 10 that the C amount is outside the range defined in the invention.

EXAMPLE 6

In this example are examined effects by an intensity of magnetic field and heat treating temperature.

The same steel as in Example 2 having containing C: 0.2 mass %, Si: 0.2 mass %, Mn: 1.3 mass % and Ti: 0.1 mass % ($Ac_1$: 715° C., $Ac_3$: 875° C.) is provided, hot rolled and cold rolled to a thickness of 1.5 mm and pickled. Moreover, true strain quantity in the cold rolling is 0.2.

Then, it is subjected to a heat treatment in a magnetic field for 0.5 minute under conditions of varying intensity of magnetic field and a heat treating temperature.

With respect to the thus obtained steels sheets, the evaluation of structure is conducted in the same manner as in Example 3.

The results are shown in Table 6.

TABLE 6

| No. | Intensity of magnetic field (T) | Heat treating temperature (° C.) | Alignment degree | Observation result of structure | Remarks |
|---|---|---|---|---|---|
| 34 | 0.05 | 745 | 0.9 | Mixed grain structure of martensite phase and ferrite phase | Comparative Example 11 |
| 35 | 0.5 | 745 | 2.0 | Honeycomb-shaped structure of martensite phase and ferrite phase | Acceptable Example 24 |
| 36 | 4.0 | 745 | 2.8 | Honeycomb-shaped structure of martensite phase and ferrite phase | Acceptable Example 25 |
| 37 | 10.0 | 745 | 3.2 | Honeycomb-shaped structure of martensite phase and ferrite phase | Acceptable Example 26 |
| 38 | 10.0 | 710 | not measurable | Polycrystal of ferrite phase | Comparative Example 12 |
| 39 | 10.0 | 910 | 0.9 | Mixed grain structure of martensite phase and ferrite phase | Comparative Example 13 |

As seen from Table 6, all of Examples 24, 25, 26 satisfying the conditions defined in the invention attain the proper control of two-phase structure.

On the contrary, Comparative Example 11 does not develop the effect by the magnetic field because the intensity of magnetic field is weak. In Comparative Example 12, the transformation does not progress because the heat treating temperature is too low. In Comparative Example 13, the control of two-phase structure can not be conducted because the heat treating temperature is too high.

EXAMPLE 7

In this example are also examined the effects by an intensity of magnetic field and a heat treating temperature.

The same steel as in Example 1 containing C: 0.61 mass %, Si: mass % and Mn: 0.60 mass % ($Ac_1$: 730° C., $Ac_3$: 788° C.) is provided, hot rolled and cold rolled to a thickness of 1.5 mm and pickled. Moreover, a true stain quantity in the cold rolling is 0.2.

Then, the steel is subjected to a heat treatment in a magnetic field for 1 minute under conditions of varying intensity of magnetic field and a heat treating temperature.

With respect to the thus obtained steel sheet, the evaluation of structure is conducted in the same manner as in Example 3.

The results are shown in Table 7.

TABLE 7

| No. | Intensity of magnetic field (T) | Heat treating temperature (° C.) | Alignment degree | Observation result of structure | Remarks |
|---|---|---|---|---|---|
| 40 | 0.05 | 745 | 0.9 | Mixed grain structure of martensite phase and ferrite phase | Comparative Example 14 |
| 41 | 0.5 | 745 | 1.8 | Honeycomb-shaped structure of martensite phase and ferrite phase | Acceptable Example 27 |
| 42 | 4.0 | 745 | 1.9 | Honeycomb-shaped structure of martensite phase and ferrite phase | Acceptable Example 28 |
| 43 | 10.0 | 745 | 2.1 | Honeycomb-shaped structure of martensite phase and ferrite phase | Acceptable Example 29 |
| 44 | 10.0 | 715 | not measurable | Polycrystal of ferrite phase | Comparative Example 15 |
| 45 | 10.0 | 810 | 0.9 | Mixed grain structure of martensite phase and ferrite phase | Comparative Example 16 |

As seen from Table 7, all of Examples 27, 28, 29 satisfying the conditions defined in the invention attain the proper control of two-phase structure.

On the contrary, Comparative Example 14 does not develop the effect by the magnetic field because the intensity of magnetic field is weak. In Comparative Example 15, the transformation does not progress because the heat treating temperature is too low. In Comparative Example 16, the control of two-phase structure can not be conducted because the heat treating temperature is too high.

EXAMPLE 8

In this example is examined a recrystallized sheet utilizing an aligned structure.

The same steel as in Example 2 containing C: 0.2 mass %, Si: 0.2 mass %, Mn: 1.3 mass % and Ti: 0.1 mass % ($Ac_1$: 715° C., $Ac_3$: 875° C.) is provided by melting under vacuum. A specimen having a length of 150 mm, a width of 25 mm and a thickness of 2 mm is cut out from the steel, rendered into γ-phase by induction heating at 1000° C., hot rolled under a condition corresponding to a true strain quantity of 0.3 and subsequently kept at 800° C. corresponding to (α+γ) two-phase temperature zone for 0.5 minute while applying a magnetic field of 10 T to conduct normal transformation. In this case, the magnetic field is applied in a thickness direction. Thereafter, the steel sheet is quenched.

Thus, the structure aligned in the thickness direction is obtained and the alignment degree is 4.0 (hereinafter referred to as magnetic field aligned steel).

Then, the steel sheet is cold rolled at a rolling reduction of 30–75% and kept at 600C for 30 minutes to conduct recrystallization.

For the comparison, the steel sheet is subjected to the same heat treatment as mentioned above without applying the magnetic field and further to cold rolling and recrystallization (hereinafter referred to as zero magnetic field steel).

The rolled face of each of these steels is polished and corroded with an alcohol solution of 3% nitric acid and observed by means of an optical microscope to measure an average grain size of recrystallized grains by an image processing. And also, an aspect ratio (size in the rolling direction/minimum extending size in a direction perpendicular to the rolling direction) is measured by an image processing for quantifying a ratio of flat grains.

Figure 6:
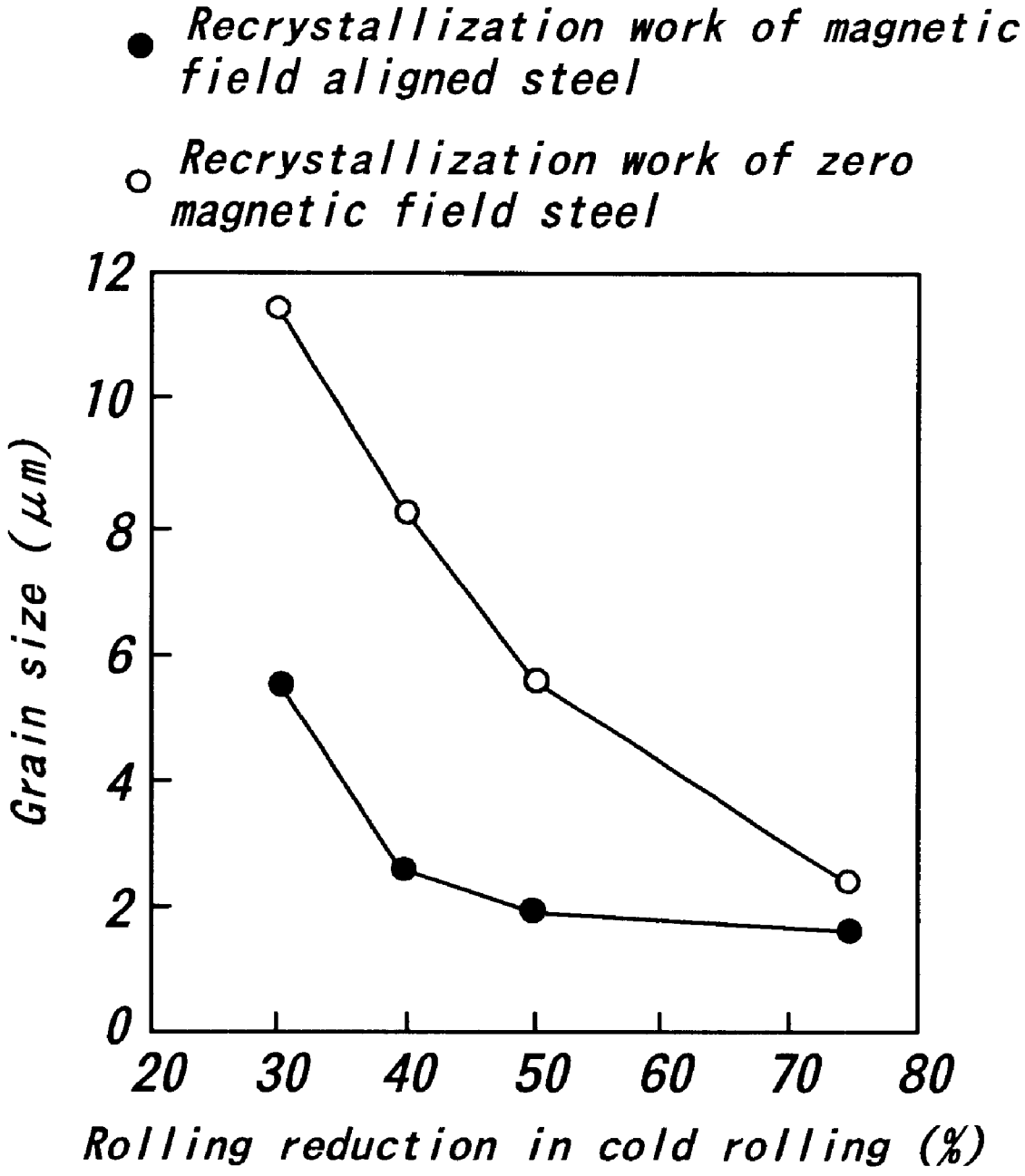
FIG. 6 is a graph showing an influence of a rolling reduction in a cold rolling upon a change of grain size in recrystallized grains.

In FIG. 6 are shown results examined on the influence of the rolling reduction in the cold rolling upon the change of grain size in the recrystallized grains.

As seen from FIG. 6, the average grain size of the recrystallized grains in the cold rolling at 40% is approximately 2.5 μm in the magnetic field aligned steel, while the average grain size becomes 2.5 μm at last through the cold rolling at 75% in case of the zero magnetic field steel.

This suggests that if the rolling is carried out at 40% per one pass in the magnetic field of zero, the effect obtained by conducting such a rolling three times (total rolling reduction: about 78%) is attained only by one pass in case of the magnetic field aligned steel.

Figure 7:
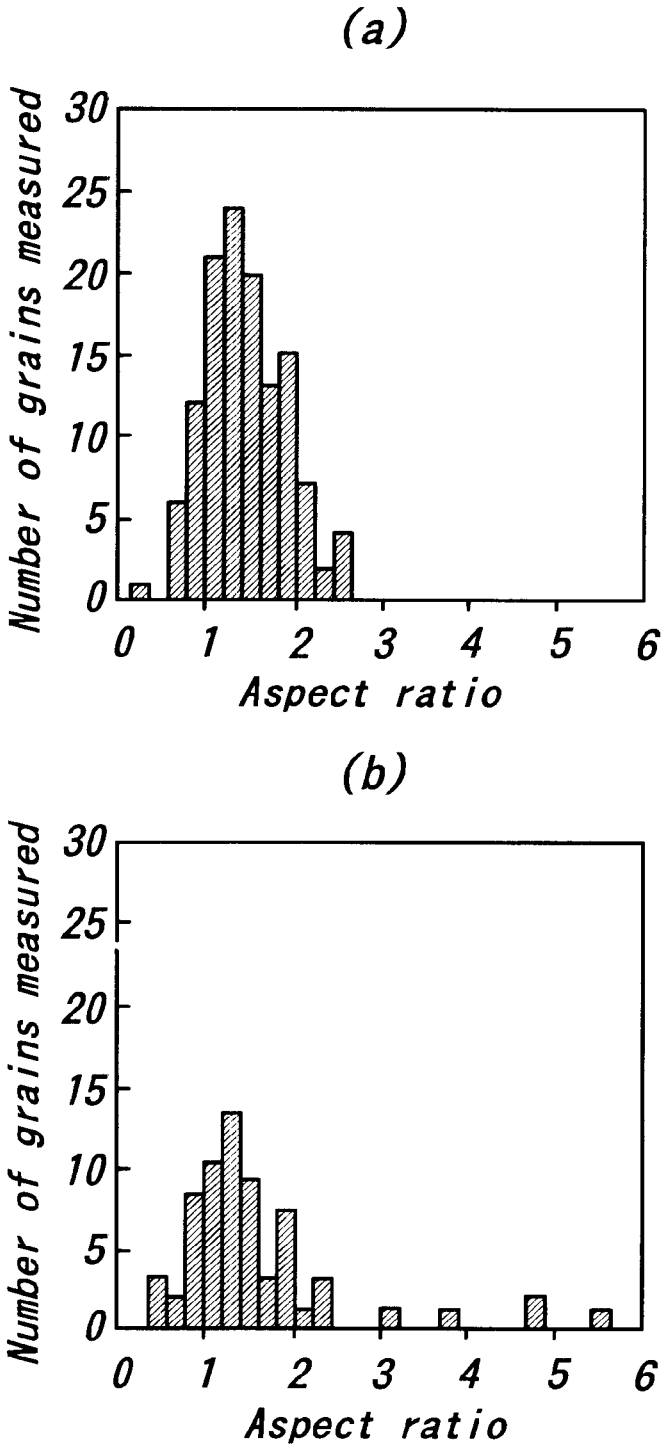
FIG. 7 is a graph showing an aspect ratio of recrystallized grains in a steel subjected to recrystallization work after heat treatment in a magnetic field, wherein (a) is a case of subjecting a steel aligned through the magnetic field to recrystallization work and (b) is a case of subjecting a steel not aligned through the magnetic field to recrystallization work.

In FIG. 7 are shown results measured on an aspect ratio when the cold rolled steel sheet obtained at a rolling reduction of 50% is subjected to a recrystallization annealing at 600° C. for 30 minutes, wherein (a) is a case of using the magnetic field aligned steel, and (b) is a case of using the zero magnetic field steel.

In case of using the magnetic field aligned steel, a sharp distribution is obtained when the aspect ratio is not more than 3, while about 7% of flat grains having an aspect ratio of not less than 3 is existent in the zero magnetic field steel.

Further, an orientation distribution of crystal grains is measured on a range of 200 μm square in the rolled face of the same steel sheets as used in FIG. 7 by means of EBSD (Electron Back Scattering Diffraction). As a result, the accumulation of (111) orientation is observed to a certain level in the zero magnetic field steel, while the accumulation of particular orientation is not quite observed in the magnetic field aligned steel and the orientation of crystal grains is random.

From the above experimental results can be derived the following important feature for industrialization.

That is, the structure aligned through the magnetic field is obtained for a very short time of about 0.5 minute, and also an equiaxial and fine grained structure having a random orientation is obtained while largely reducing a rolling load by subjecting to recrystallization annealing. Example 9

An experimental plant is constructed assuming an industrialized process below.

Figure 8:
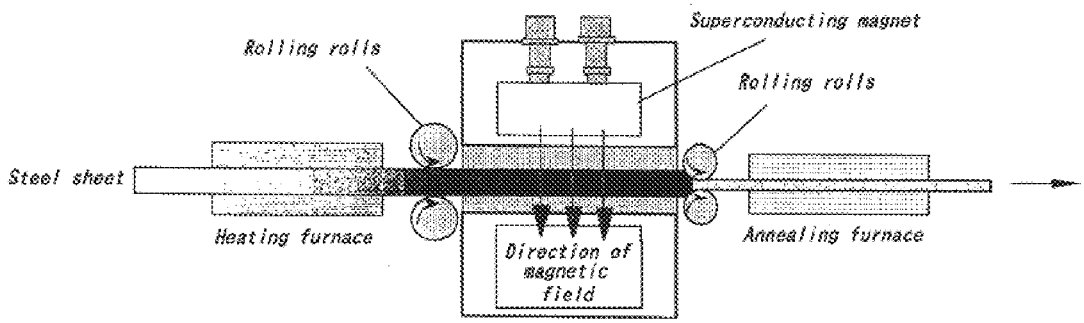
FIG. 8 is a schematic view showing an outline of an experimental equipment utilizing a strong magnetic field.

As shown in FIG. 8, a treating installation is constructed with heating furnace—rolling rolls—superconducting magnet—rolling rolls—annealing furnace, whereby γ-zone heating—hot rolling—transformation in magnetic field—work—recrystallization annealing are conducted continuously.

A test steel is obtained by melting the same composition as in Example 2 under vacuum and has a length of 300 mm, a width of 50 mm and a thickness of 15 mm. And also, the experiment is carried out under the following conditions.

The test steel is heated to 1000° C. to form γ-phase. Then, it is subjected to hot rolling at a true strain quantity of 0.3. Subsequently, it is passed through the superconducting magnet, during which a heat treatment is carried out at 800° C. in a magnetic field of 10 T for 20 seconds to progress normal transformation to about 50% in (α+γ) two-phase zone. Thereafter, it is rolled at 700° C. and a rolling reduction of 40% and passed through the annealing furnace at 600° C. to conduct recrystallization. In this case, the steel passing rate is 4 m/min.

The rolled face of the thus obtained steel sheet is polished, corroded with an alcohol solution of 3% nitric acid and observed by means of an optical microscope to measure a grain size distribution of recrystallized grains in the same manner as in Example 8. And also, a part of the test steel is quenched after the transformation in the magnetic field to measure an alignment degree of the structure aligned through the magnetic field.

As a result, the alignment degree after the transformation in the magnetic field is 3.8 and also the average grain size of the recrystallized grains is 2.1 μm, and there is obtained an equiaxial and fine grained structure wherein a high angle grain boundary is majority.

Further, a tension test piece of JIS No. 13B is cut out from the sheet in the longitudinal direction to measure tensile strength (tension rate: 10 mm/s) and total elongation, while a Charpy impact test piece of sub-size (length: 50 mm, width: 10 mm, thickness: 5 mm) is cut out and a U-shaped notch is formed therein, which is subjected to an impact test at room temperature.

As a result, the tensile strength is 750 MPa, and the total elongation is 30%, and the absorption energy is 150 J.

For the comparison, the impact test is carried out on the test steel having the same composition and obtained by subjecting to the heat treatment without applying the magnetic field. In this case, the average grain size is 10 μm, and the tensile strength is 450 MPa, and the total elongation is 35%, and the absorption energy is 160 J.

In other words, the formation of fine grains is attained by utilizing the magnetic field according to the invention. The good mechanical properties are obtained without damaging the toughness. It is clear that the invention is very effective in the production of steels for forming fine grains by rolling—recrystallization to provide higher strength and toughness.

As mentioned above, according to the invention, the structure control of the two-phase steel can be carried out in a low cost for a short time, so that it is very useful in industry.

what is claimed is:

1. A method for controlling a structure of a two-phase steel, characterized in that a steel containing C: 0.05–0.80 mass % is subjected to a strain work of not less than 0.1 at a temperature of γ-phase zone and then a magnetic field of 0.1–20 T is applied to the steel at a temperature of a two-phase (α+γ) zone to form a two-phase steel.

2. The method according to claim 1, wherein the magnetic field is 1–20 T.

3. The method according to claim 2, wherein the magnetic field is 4–20 T.

4. A method for controlling a structure of a two-phase steel, characterized in that a steel containing C: 0.05–0.80 mass % is subjected to a strain work of not less than 0.1 at a temperature of α-phase zone and then a magnetic field of 0.1–20 T is applied to the steel at a temperature of a two-phase zone (α+γ) zone to form a two-phase steel.

5. The method according to claim 4, wherein the magnetic field is 1–20 T.

6. The method according to claim 5, wherein the magnetic field is 4–20 T.

7. A method for controlling a structure of a two-phase steel, wherein a steel containing C: 0.05–0.80 mass % is subjected to a strain work of not less than 0.1 at a temperature of one of an α-phase zone and a γ-phase zone and then a magnetic filed of 0.1–20 T is applied to the steel at a temperature of a two-phase, α-phase and γ-phase, zone to form a two-phase steel.

8. The method according to claim 7, wherein the magnetic field is 1–20 T.

9. The method according to claim 8, wherein the magnetic field is 4–20 T.

* * * * *